US008246038B2

(12) United States Patent
Ugajin

(10) Patent No.: US 8,246,038 B2
(45) Date of Patent: Aug. 21, 2012

(54) MEDIUM TRANSFER DEVICE AND AUTOMATIC PAPER CURRENCY DEPOSIT/WITHDRAWAL MACHINE

(75) Inventor: Kazuhide Ugajin, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 12/737,375

(22) PCT Filed: May 19, 2009

(86) PCT No.: PCT/JP2009/059201

§ 371 (c)(1),
(2), (4) Date: Jan. 6, 2011

(87) PCT Pub. No.: WO2010/004808

PCT Pub. Date: Jan. 14, 2010

(65) Prior Publication Data

US 2011/0109034 A1 May 12, 2011

(30) Foreign Application Priority Data

Jul. 7, 2008 (JP) ..... 2008-176481

(51) Int. Cl.
*B65H 85/00* (2006.01)

(52) U.S. Cl. ..... 271/3.18; 271/306; 271/198

(58) Field of Classification Search ..... 271/198, 271/3.18, 306, 69, 272, 264
See application file for complete search history.

(56) References Cited

U.S. PATENT DOCUMENTS 7,243,914 B2 * 7/2007 Tokunaga et al. ..... 271/3.01
7,871,069 B2 * 1/2011 Lee et al. ..... 271/178

FOREIGN PATENT DOCUMENTS

| | | | |
|---|---|---|---|
| JP | U59-008949 | | 1/1984 |
| JP | 03-148791 | A | 6/1991 |
| JP | 06-183621 | A | 7/1994 |
| JP | 07-196223 | A | 8/1995 |
| JP | 7-200923 | A | 8/1995 |
| JP | 08-188314 | A | 7/1996 |
| JP | 08-208092 | A | 8/1996 |
| JP | 2003-048656 | A | 2/2003 |

OTHER PUBLICATIONS

Notice of Reason for Rejection (and its English-language translation), issued in connection with the corresponding Japanese patent application, dated Oct. 18, 2011.

* cited by examiner

*Primary Examiner* — Kaitlin S Joerger
(74) *Attorney, Agent, or Firm* — Rabin & Berdo, P.C.

(57) ABSTRACT

Provided is a paper-currency transfer device, which prevents paper-currency clogging in a paper-currency transfer unit composed of a plurality of transfer units and which neither has a complicated structure nor needs a dedicated drive source. A medium transfer device transfers a medium from a sending-side paper-currency transfer passage as a first transfer passage to a receiving-side paper-currency transfer passage as a second transfer passage. The medium transfer device comprises a runner mounted coaxially with a transfer roller on a receiving side of the receiving-side paper-currency transfer passage. The runner is rotated at a higher speed than that of the transfer roller on the receiving side. The drive source of the runner is common to that of the transfer roller.

12 Claims, 6 Drawing Sheets

MEDIUM TRANSFER DEVICE AND AUTOMATIC PAPER CURRENCY DEPOSIT/WITHDRAWAL MACHINE

TECHNICAL FIELD

The present invention relates to a medium transfer device of an automatic paper currency deposit/withdrawal machine installed in financial institutions and the like and receiving and paying paper currency.

BACKGROUND ART

The conventional automatic paper currency deposit/withdrawal machine performs money withdrawal processing of currency, such as paper currency, from an internal safe by customer's operation and money deposit processing of storing, in the internal safe, paper currency and the like received from a customer. In the money withdrawal processing, paper currency is transferred from the internal safe to a customer section through a paper currency transfer section. In the money deposit processing, paper currency is transferred from the customer section to the internal safe through the paper currency transfer section.

FIGS. 8A and 8B are side views schematically showing a paper currency transfer section of the conventional automatic paper currency deposit/withdrawal machine. FIG. 8A is a side view schematically showing a transfer unit of the paper currency transfer section. A paper currency transfer passage 80 includes transfer rollers 82*a*, 82*b*, 83*a*, and 83*b* and transfer belts 84*a* and 84*b*. The upper transfer belt 84*a* is stretched between the transfer rollers 82*a* and 83*a* and rotated in the arrow direction by a drive source (not shown). As with the upper transfer belt 84*a*, the lower transfer belt 84*b* is stretched between the transfer rollers 82*b* and 83*b* and rotated in the arrow direction by a drive source (not shown). The upper and lower transfer belts 84*a* and 84*b* rotate while interposing paper currency P in between to thereby transfer the paper currency P in the arrow direction.

FIG. 8B is a side view showing delivery between transfer units of the paper currency transfer section. A sending-side paper currency transfer passage 81 shown in FIG. 8B and a receiving-side paper currency transfer passage 91 having the same constitution as that of the sending-side paper currency transfer passage 81 are provided respectively on the upstream side and the downstream side in the transfer direction of the paper currency P. A delivery section for delivering the paper currency P is constituted between a transfer unit as the sending-side paper currency transfer passage 81 and a transfer unit as the receiving-side paper currency transfer passage 91. Those transfer units and the delivery section are continuously constituted between constitutive units such as the customer section and the internal safe in the automatic paper currency deposit/withdrawal machine to constitute the paper currency transfer section. In the paper currency transfer section, the paper currency P is sent out from the sending-side paper currency transfer passage 81 to be received in the receiving-side paper currency transfer passage 91, and, thus, to be transferred between each of the transfer units from the upstream to the downstream in the transfer direction.

The transferred paper currency P has no rigidity and is thin and soft. Since, in particular, paper currency to be received is used under various conditions, many of the paper currencies may be deformed. FIGS. 9A, 9B, and 9C are explanatory view showing a transfer state of paper currency in the conventional paper currency transfer section. FIG. 9A is an explanatory view showing the paper currency P with a bent and deformed front end P-1. FIG. 9B is an explanatory view showing the paper currency P generally curved including the front end P-1. As shown in FIGS. 9A and 9B, when the paper currency P is transferred in the arrow direction, there is the paper currency P with the deformed front end P-1 in the transfer direction.

FIG. 9C is a side view showing delivery of the deformed paper currency between the transfer units of the paper currency transfer section. When the deformed paper currency P is transferred, and in particular when the paper currency P is sent out from the sending-side transfer belts 84*a* and 84*b*, the constraint to the front end P-1 of the paper currency P disappears between the sending-side paper currency transfer passage 81 and the receiving-side paper currency transfer passage 91, and therefore, the state of the front end P-1 becomes unstable. Consequently, as shown in FIG. 9C, the front end P-1 of the paper currency P is abutted against the receiving transfer belt 94*a* and 92*a* of the receiving-side paper currency transfer passage 91 to be further deformed or buckled, so that the paper currency P cannot be finally transferred to the receiving-side paper currency transfer passage 91 due to jamming of paper currency.

In order to solve the above problem, Japanese Patent Application Laid-Open (JP-A) No. 7-200923 discloses a technique for preventing the paper currency jamming at the paper currency delivery portion. Namely, in JP-A No. 7-200923, a paper currency guide member performing swinging motion is provided at the paper currency delivery portion, and a delivery passage is enlarged or reduced by the swinging motion of the paper currency guide member.

SUMMARY OF INVENTION

Technical Problem

However, in JP-A No. 7-200923, since the paper currency guide member performing swinging motion is required to be provided at the paper currency delivery portion, the structure is complicated. Further, a dedicated drive source for making the paper currency guide member perform the swinging motion is required to be provided.

The present invention provides a medium transfer device, which prevents jamming of paper currency in a paper currency transfer section constituted of plural transfer units, and, at the same time, does not complicate the structure, and has a paper currency transfer section requiring no dedicated drive source.

Solution to Problem

An aspect of the present invention is a medium transfer device, which delivers a medium from a first transfer passage to a second transfer passage, including: a receiving-side transfer roller of the second transfer passage; and a bladed wheel provided coaxially with the receiving-side transfer roller.

Advantageous Effects of Invention

According to the present invention, there can be obtained a medium transfer device, which prevents jamming of paper currency in a paper currency transfer section constituted of plural transfer units, and, at the same time, does not complicate the structure, and has a paper currency transfer section requiring no dedicated drive source.

DESCRIPTION OF EMBODIMENTS

First Exemplary Embodiment

Figure 2:
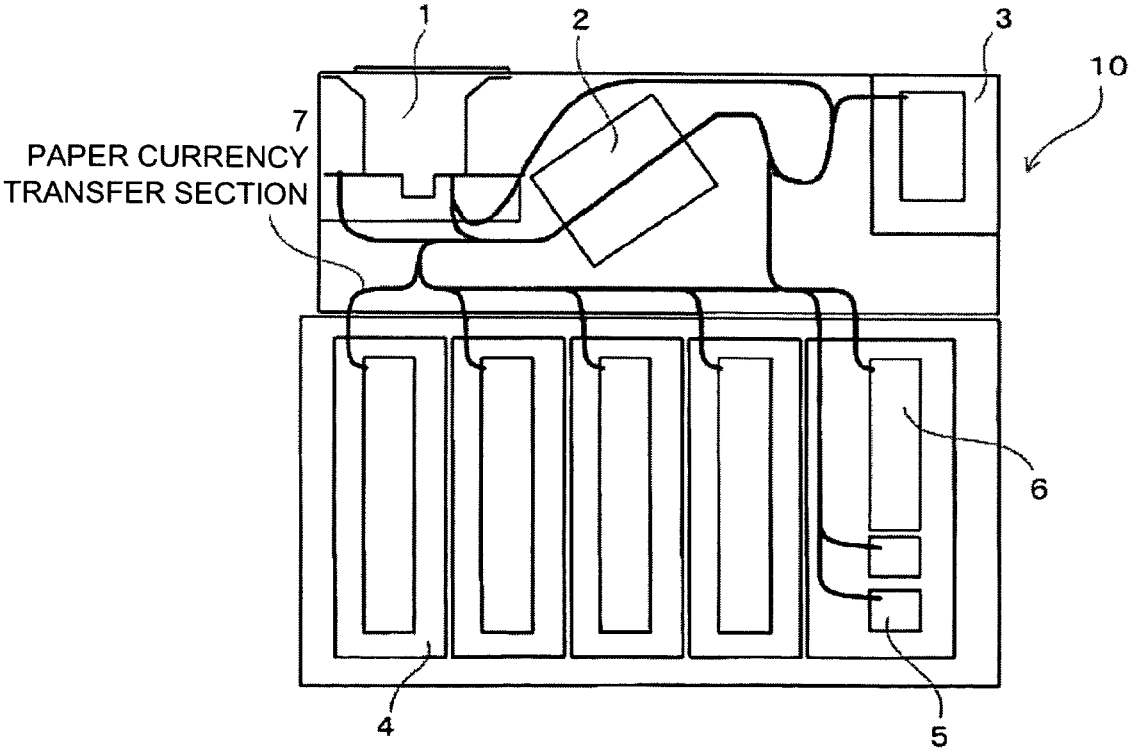
FIG. 2 is a configuration diagram showing a schematic configuration of an automatic paper currency deposit/withdrawal machine.

Hereinafter, a first exemplary embodiment is described. FIG. 2 is a configuration diagram showing a schematic configuration of an automatic paper currency deposit/withdrawal machine 10 according to the first exemplary embodiment. In FIG. 2, a customer section 1 stores paper currency P to be given to customers in money withdrawal processing and takes the paper currency P, received from customers, into the device in money deposit processing. A discrimination section 2 determines the authenticity of the deposited or withdrawn paper currency P and, at the same time, determines the number of the paper currencies P. A temporary holding section 3 accumulates the deposited paper currency P and temporarily reserves the paper currency P. A storage section 4 is operated as an internal safe for storing the paper currency P to be withdrawn.

A reject cassette section 5 stores the paper currency P unfit for handling by the automatic paper currency deposit/withdrawal machine 10. A supply/collection section 6 supplies the paper currency P in the storage section 4 and collects the received paper currency P. A paper currency transfer section 7 is disposed to connect the constitutive units each other and transfers the paper currency P between the constitutive units.

Figure 1:
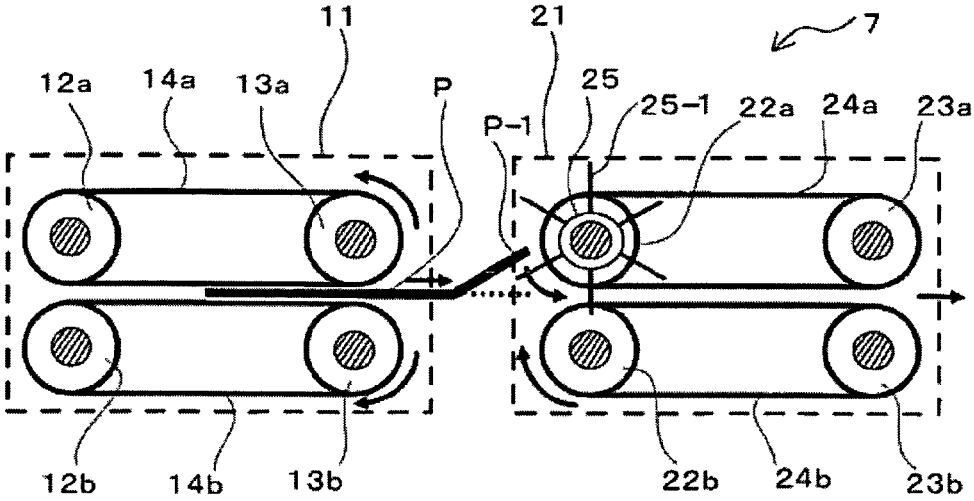
FIG. 1 is a side view showing delivery between transfer units of a paper currency transfer section according to a first exemplary embodiment.

FIG. 1 is a side view showing delivery between the transfer units of the paper currency transfer section 7 according to the first exemplary embodiment. A sending-side paper currency transfer passage 11 as a first transfer passage includes transfer rollers 12*a*, 12*b*, 13*a*, and 13*b* and transfer belts 14*a* and 14*b*. The upper transfer belt 14*a* is stretched between the transfer rollers 12*a* and 13*a* and rotated in the arrow direction at a predetermined rotation speed by a drive source (not shown). As with the upper transfer belt 14*a*, the lower transfer belt 14*b* is stretched between the transfer rollers 12*b* and 13*b* and rotated in the arrow direction at a predetermined rotation speed by a drive source (not shown). The upper and lower transfer belts 14*a* and 14*b* rotate while interposing the paper currency P in between to thereby transfer the paper currency P in the arrow direction that is the downstream of the paper currency transfer section 7. The sending-side transfer rollers 13*a* and 13*b* of the transfer rollers 12*a*, 12*b*, 13*a*, and 13*b* send and give the paper currency P to a receiving-side paper currency transfer passage 21 next to the sending-side paper currency transfer passage 11.

The receiving-side paper currency transfer passage 21 as a second transfer passage is provided on the downstream side in the transfer direction of the paper currency P. The delivery section of the paper currency P is constituted between the transfer unit as the sending-side paper currency transfer passage 11 and the transfer unit as the receiving-side paper currency transfer passage 21. Each of the transfer units and the delivery section are continuously constituted between each of the constitutive units such as the customer section 1 and the storage section 4 in the automatic paper currency deposit/withdrawal machine 10 to constitute the paper currency transfer section 7. The paper currency P is sent out from the sending-side paper currency transfer passage 11 to be received in the receiving-side paper currency transfer passage 21, and, thus, to be transferred between each of the transfer units from the upstream to the downstream in the transfer direction.

The receiving-side paper currency transfer passage 21 includes transfer rollers 22*a*, 22*b*, 23*a*, and 23*b*, transfer belts 24*a* and 24*b*, and a bladed wheel 25. The upper transfer belt 24*a* is stretched between the transfer rollers 22*a* and 23*a* and rotated in the arrow direction by a drive source (not shown). As with the upper transfer belt 24*a*, the lower transfer belt 24*b* is stretched between the transfer rollers 22*b* and 23*b* and rotated in the arrow direction by a drive source (not shown). The upper and lower transfer belts 24*a* and 24*b* rotate while interposing the paper currency P in between to thereby transfer the paper currency P in the arrow direction that is the downstream of the paper currency transfer section 7. The receiving-side transfer rollers 22*a* and 22*b* of the transfer rollers 22*a*, 22*b*, 23*a*, and 23*b* receive the paper currency P sent from the sending-side paper currency transfer passage 11 on the upstream side.

In the first exemplary embodiment, the bladed wheel 25 is provided coaxially with the receiving-side transfer roller 22*a*. The bladed wheel 25 has plural blades 25-1 formed of an elastic body and is rotated in the arrow direction by a drive source to be described later. When the paper currency P sent from the sending-side paper currency transfer passage 11 on the upstream side has the deformed front end P-1, the blades 25-1 of the rotated bladed wheel 25 force the front end P-1 downward. According to this constitution, the deformed front end P-1 of the paper currency P is forced downward by the blades 25-1 of the rotated bladed wheel 25 before being abutted against the receiving-side transfer roller 22*a*. The front end P-1 of the paper currency P is then introduced in between the receiving-side transfer rollers 22*a* and 22*b* and, in other words, between the upper and lower transfer belts 24*a* and 24*b*, so that the transfer in the receiving-side paper currency transfer passage 21 is facilitated.

Figure 3:
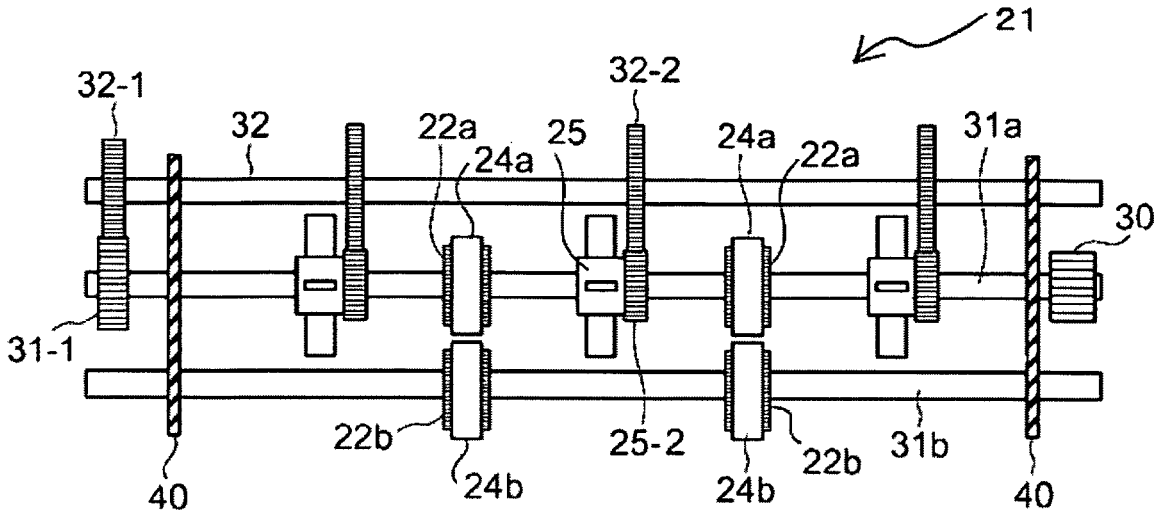
FIG. 3 is a front view of a receiving-side paper currency transfer passage as viewed from the upstream side.

FIG. 3 is a front view of the receiving-side paper currency transfer passage 21 as viewed from the upstream side. The roller shafts 31*a* and 31*b* and a gear shaft 32 are supported in parallel by right and left support frames 40. The transfer belts 24*a* and 24*b* are stretched respectively over the transfer roller 22*a* and 22*b*, and the transfer roller 22*a* and 22*b* are provided so as to be fixed at two positions of the roller shafts 31*a* and 31*b*. The upper transfer roller 22*a* is rotated by the roller shaft 31*a* through a drive gear 30 by a drive source (not shown).

The bladed wheel 25 is coaxial with the transfer roller 22*a* and is provided rotatably around the roller shaft 31*a* through a bearing. The bladed wheels 25 and the transfer rollers 22*a* are alternately provided. The bladed wheels 25 are provided at three positions in a direction vertical to the transfer direction of the paper currency P. The bladed wheel 25 is rotated at higher speed than the transfer roller 22*a* by the rotation of the roller shaft 31*a*. In order to obtain the rotation of the bladed wheel 25, the rotation of the roller shaft 31*a* is transmitted to a roller shaft gear 31-1 and a gear shaft gear 32-1 to the gear shaft 32 to be further transmitted to a gear shaft gear 32-2 and a bladed wheel gear 25-2. The bladed wheel gear 25-2 is formed integrally with the bladed wheel 25. The drive source of the bladed wheel 25 is used in common with the drive source of the transfer roller 22*a*.

According to the above constitution, the bladed wheel 25 starts rotating simultaneously with the rotation of the transfer roller 22*a*. The bladed wheel 25 can rotate at higher speed than the transfer roller 22*a* by a gear ratio between the roller shaft gear 31-1, the gear shaft gear 32-1, the gear shaft gear 32-2, and the bladed wheel gear 25-2. Since the bladed wheel 25 rotates at higher speed than the transfer roller 22*a*, the blades 25-1 of the bladed wheel 25 force downward the front end P-1 of the paper currency P.

The number of rotations of the bladed wheel 25 is experimentally obtained. The bladed wheel 25 is provided rotatably around the roller shaft 31*a* through the bearing. However, since the bladed wheel 25 is regulated by a regulating member (not shown), the bladed wheel 25 does not move in the axial direction of the roller shaft 31*a*. A transfer guide (not shown) regulating the paper currency P in a direction vertical to the transfer direction of the paper currency P may be provided according to need.

Figure 4:
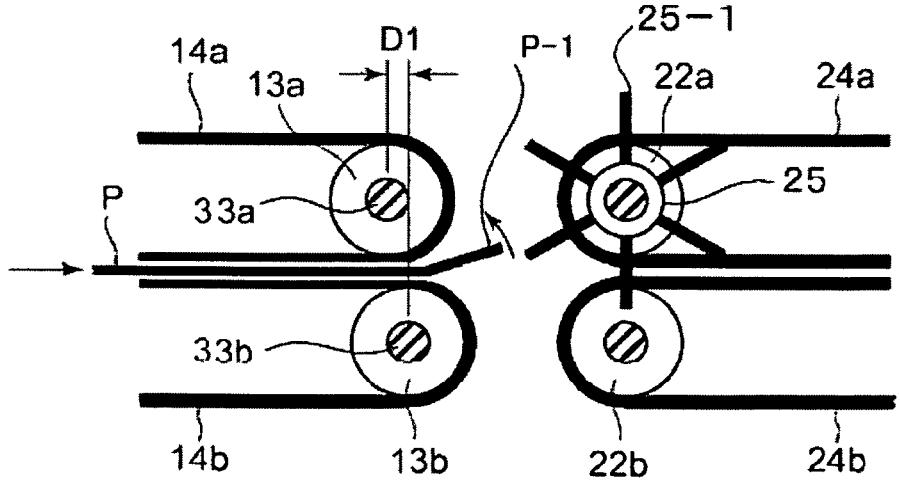
FIG. 4 is a side view showing a variation of the delivery between the transfer units of the paper currency transfer section according to the first exemplary embodiment.

FIG. 4 is a side view showing a variation of the delivery between the transfer units of the paper currency transfer section 7 according to the first exemplary embodiment. FIG. 4 shows that there is a gap between the roller shafts 33*a* and 33*b* supporting the sending-side transfer rollers 13*a* and 13*b* in the sending-side paper currency transfer passage 11. Namely, the roller shaft 33*b* of the lower transfer roller 13*b* is located on the more downstream side than the roller shaft 33*a* of the upper transfer roller 13*a* by a gap D1. According to this constitution, the front end P-1 of the paper currency P is slightly twisted upward as shown by the arrow, and the blades 25-1 of the bladed wheel 25 exercise the effect of forcing the front end P-1 of the paper currency P downward.

According to the first exemplary embodiment, in the paper currency transfer section 7 constituted of the plural transfer units, the bladed wheel 25 is provided coaxially with the receiving-side transfer roller 22*a* as the second transfer passage. Thus, even if the front end P-1 of the paper currency P is folded, the front end P-1 of the paper currency P is not abutted against the transfer roller 22*a* and the transfer belt 24*a*, and the front end P-1 of the paper currency P can be easily introduced in between the transfer belts 24*a* and 24*b* in the second transfer passage. Consequently, there can be obtained a medium transfer device which can prevent jamming of paper currency from occurring in the paper currency delivery section between the units, and, at the same time, does not complicate the structure, and has the paper currency transfer section 7 requiring no dedicated drive source.

Second Exemplary Embodiment

Figure 5:
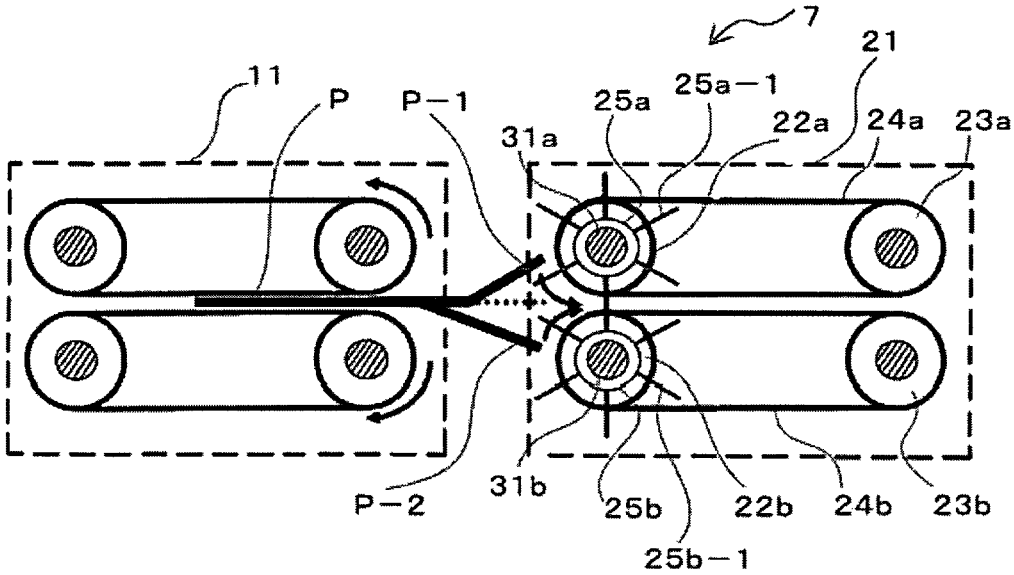
FIG. 5 is a side view showing delivery between the transfer units of a paper currency transfer section according to a second exemplary embodiment.

Next, a second exemplary embodiment is described. FIG. 5 is a side view showing the delivery between the transfer units of the paper currency transfer section 7 according to the second exemplary embodiment. Since the sending-side paper currency transfer passage 11 as the first transfer passage is similar to that of the first exemplary embodiment, the description of the first exemplary embodiment is incorporated.

Further, as in the first exemplary embodiment, also in the second exemplary embodiment, a delivery section of paper currency P is constituted between the transfer unit as the sending-side paper currency transfer passage 11 and the transfer unit as a receiving-side paper currency transfer passage 21, and each of the transfer units and the delivery section are continuously constituted between each of the constitutive units such as the customer section 1 and the storage section 4 in the automatic paper currency deposit/withdrawal machine 10. Thus, the description of the first exemplary embodiment is incorporated.

The receiving-side paper currency transfer passage 21 includes transfer rollers 22*a*, 22*b*, 23*a*, and 23*b*, transfer belts 24*a* and 24*b*, and bladed wheels 25*a* and 25*b*. The upper transfer belt 24*a* is stretched between the transfer rollers 22*a* and 23*a* and rotated in the arrow direction at a predetermined rotation speed by a drive source (not shown). As with the upper transfer belt 24*a*, the lower transfer belt 24*b* is stretched between the transfer rollers 22*b* and 23*b* and rotated in the arrow direction at a predetermined rotation speed by a drive source (not shown). The upper and lower transfer belts 24*a* and 24*b* rotate while interposing the paper currency P in between to thereby transfer the paper currency P in the arrow direction that is the downstream of the paper currency transfer section 7. The receiving-side transfer rollers 22*a* and 22*b* of the transfer rollers 22*a*, 22*b*, 23*a*, and 23*b* receive the paper currency P sent from the sending-side paper currency transfer passage 11 on the upstream side.

In the second exemplary embodiment, the bladed wheel 25*a* is provided coaxially with the receiving-side transfer roller 22*a* provided on the upper side. The bladed wheel 25*b* is provided coaxially with the receiving-side transfer roller 22*b* provided on the lower side. The bladed wheels 25*a* and 25*b* respectively have plural blades 25*a*-1 and 25*b*-1 formed of an elastic body and are rotated in the arrow direction by a drive source to be described later. When the paper currency P sent from the sending-side paper currency transfer passage 11 on the upstream side has the front end P-1 deformed upward, the blades 25*a*-1 of the upper bladed wheel 25*a* force the front end P-1 downward before the front end P-1 is abutted against the receiving-side transfer roller 22*a*. Meanwhile, when the paper currency P has a front end P-2 deformed downward, the blades 25*b*-1 of the lower bladed wheel 25*b* force the front end P-2 upward before the front end P-2 is abutted against the receiving-side transfer roller 22*b*. According to this constitution, the deformed front end P-1 or P-2 of the paper currency P is introduced in between the receiving-side transfer rollers 22*a* and 22*b* and, in other words, between the upper and lower transfer belts 24*a* and 24*b*, so that the transfer in the receiving-side paper currency transfer passage 21 is facilitated.

According to the above constitution, when a bundle of the paper currencies P is transferred, even if the front ends P-1 and P-2 of the paper currencies P are deformed upward or downward, the paper currencies P can be introduced in between the transfer belts 24*a* and 24*b* by the blades 25*a*-1 and 25*b*-1 of the bladed wheels 25*a* and 25*b*.

Figure 6:
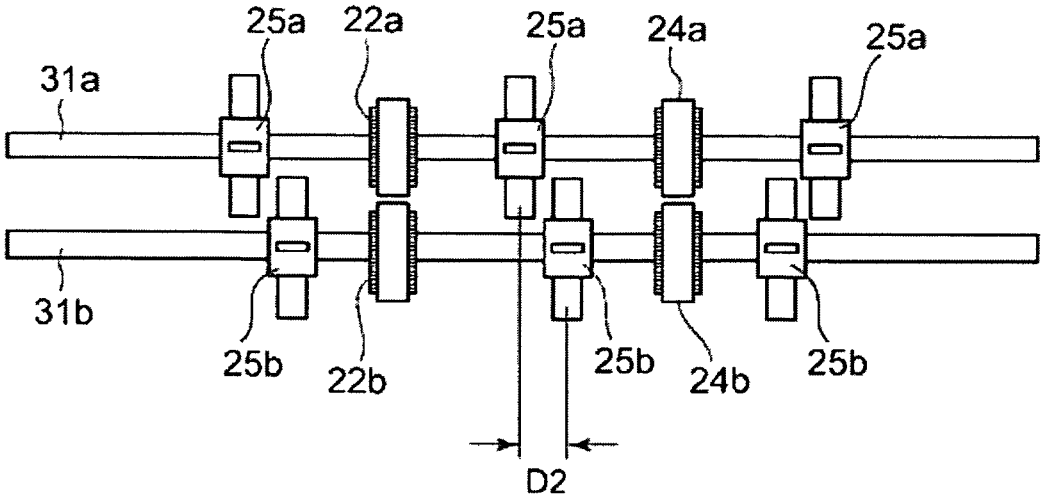
FIG. 6 is a partially omitted front view of the receiving-side paper currency transfer passage as viewed from the upstream side.

FIG. 6 is a partially omitted front view of the receiving-side paper currency transfer passage 21 as viewed from the upstream side. In FIG. 6, a drive system is omitted. The upper roller shaft 31*a* has the two fixed transfer rollers 22*a*, and the transfer belts 24*a* are stretched over the transfer rollers 22*a*. The roller shaft 31*a* has the three bladed wheels 25*a* rotatably provided through a bearing so as to be coaxial with the transfer rollers 22*a*. As with the upper roller shaft 31*a*, the lower roller shaft 31*b* also has the two fixed transfer rollers 22*b*, and the transfer belts 24*b* are stretched over the transfer rollers 22*b*. The roller shaft 31*b* has the three bladed wheels 25*b* rotatably provided through a bearing so as to be coaxial with the transfer rollers 22*b*. In order to prevent the blades 25*a*-1 and the blades 25*b*-1 from interfering with each other, a gap D2 is provided between the positions where the upper and lower bladed wheels 25*a* and 25*b* are provided, as shown in FIG. 6.

Figure 7:
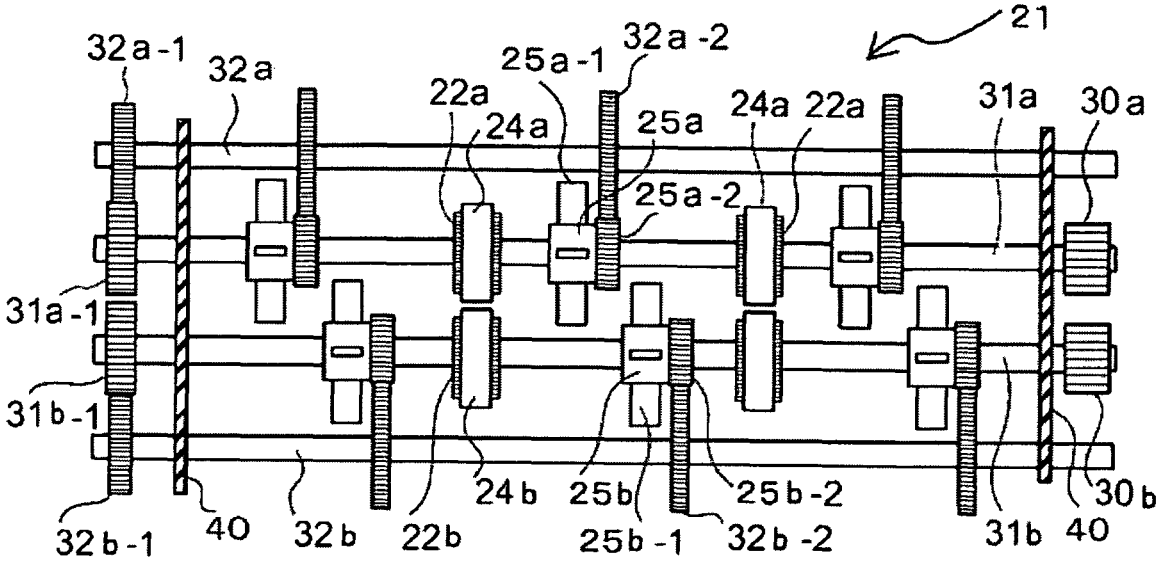
FIG. 7 is a front view of the receiving-side paper currency transfer passage as viewed from the upstream side.
Figure 8A:
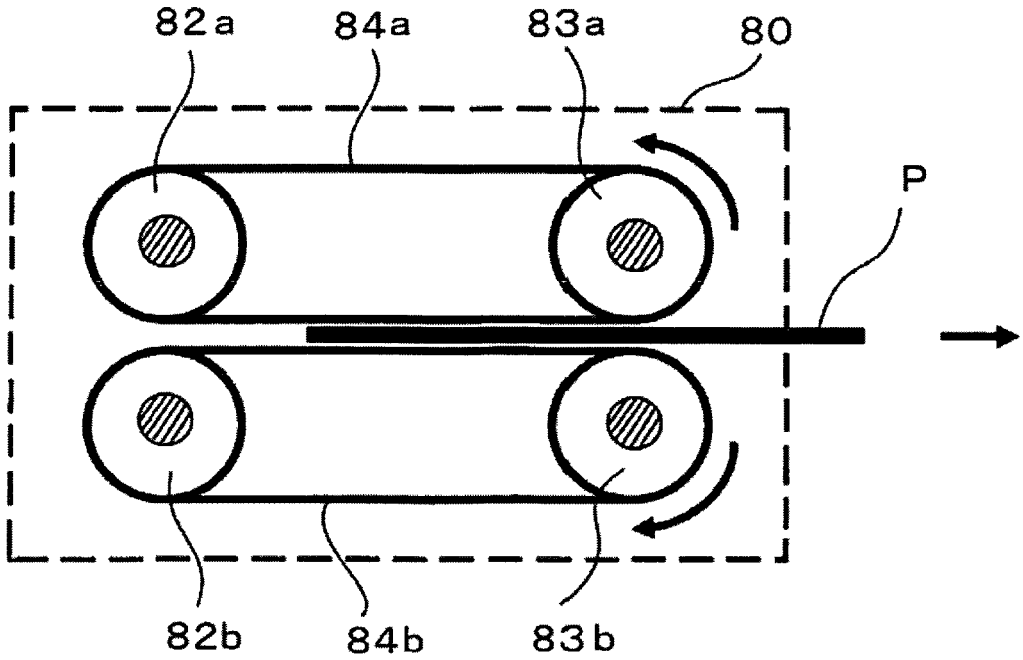
FIG. 8A is a side view schematically showing a paper currency transfer section of the conventional automatic paper currency deposit/withdrawal machine.
Figure 8B:
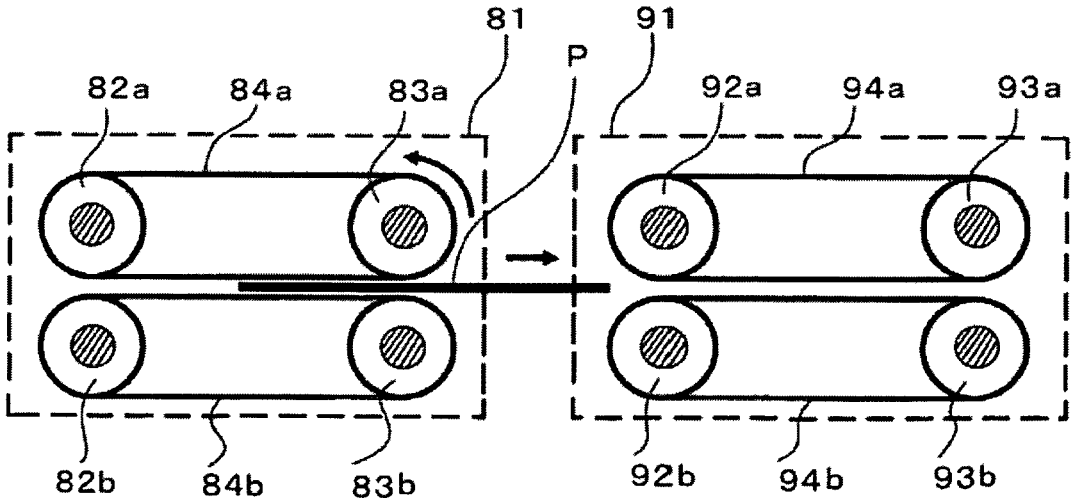
FIG. 8B is a side view schematically showing a paper currency transfer section of the conventional automatic paper currency deposit/withdrawal machine.
Figure 9A:
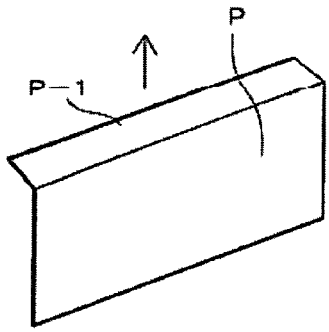
FIG. 9A is an explanatory view showing a transfer state of paper currency in the conventional paper currency transfer section.
Figure 9B:
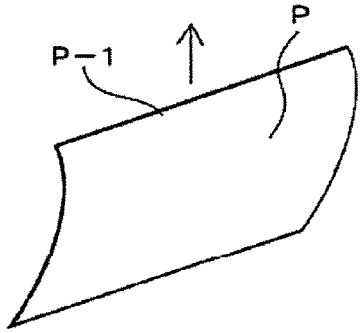
FIG. 9B is an explanatory view showing a transfer state of paper currency in the conventional paper currency transfer section.
Figure 9C:
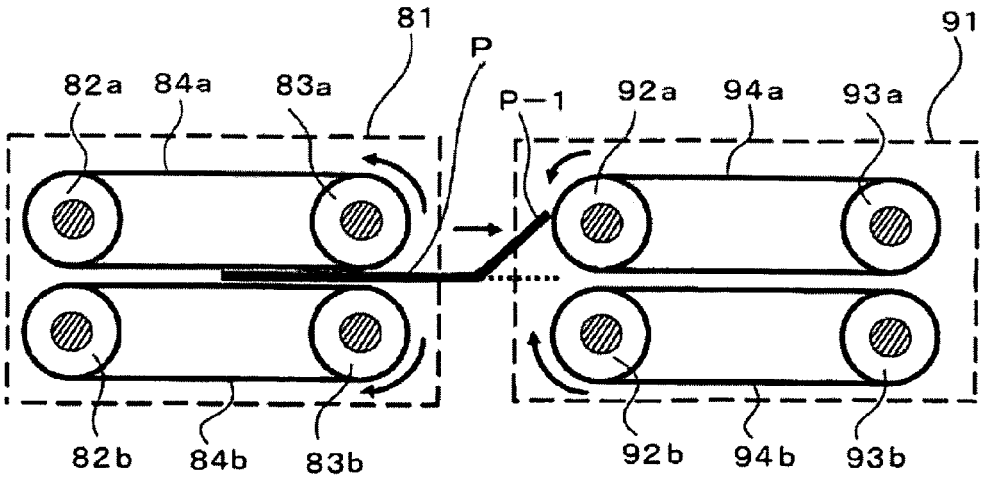
FIG. 9C is an explanatory view showing a transfer state of paper currency in the conventional paper currency transfer section.

FIG. 7 is a front view of the receiving-side paper currency transfer passage 21 as viewed from the upstream side. The roller shafts 31*a* and 31*b* and gear shafts 32*a* and 32*b* are supported in parallel by support frames 40. The transfer belts 24*a* and 24*b* are stretched respectively over the transfer roller 22*a* and 22*b*, and the transfer roller 22*a* and 22*b* are provided respectively around the roller shafts 31*a* and 31*b*. The upper transfer roller 22*a* is rotated by the roller shaft 31*a* through a drive gear 30*a* by a drive source (not shown). Likewise, the lower transfer roller 22*b* is rotated by the roller shaft 31*b* through a drive gear 30*b*.

The upper bladed wheel 25*a* is coaxial with the transfer roller 22*a* and provided rotatably around the roller shaft 31*a* through a bearing. The upper bladed wheels 25*a* and the transfer rollers 22*a* are alternately provided. The upper bladed wheels 25*a* are provided at three positions of the roller shaft 31*a* in a direction vertical to the transfer direction of the paper currency P. The upper bladed wheels 25*a* are rotated at higher speed than the transfer roller 22*a* by the rotation of the roller shaft 31*a*. The rotation of the upper bladed wheels 25*a* is transmitted from a roller shaft gear 31*a*-1 and a gear shaft gear 32*a*-1 to a gear shaft 32*a* by the rotation of the roller shaft 31*a* to be then transmitted to a gear shaft gear 32*a*-2 and a bladed wheel gear 25*a*-2. The bladed wheel gear 25*a*-2 is formed integrally with the bladed wheel 25*a*. The drive source of the upper bladed wheel 25*a* is used in common with the drive source of the transfer roller 22*a*. According to this constitution, the bladed wheel 25*a* starts rotating simultaneously with the rotation of the transfer roller 22*a*. The bladed wheel 25*a* can rotate at higher speed than the transfer roller 22*a* by a gear ratio between the roller shaft gear 31*a*-1, the gear shaft gear 32*a*-1, the gear shaft gear 32*a*-2, and the bladed wheel gear 25*a*-2. Since the bladed wheel 25*a* rotates at higher speed than the transfer roller 22*a*, the blades 25*a*-1 of the bladed wheel 25*a* force the front end P-1 of the paper currency P downward.

Meanwhile, the lower bladed wheel 25*b* is coaxial with the transfer roller 22*b* and provided rotatably around the roller shaft 31*b*. The lower bladed wheels 25*b* and the transfer rollers 22*b* are alternately provided. The lower bladed wheels 25*b* are provided at three positions of the roller shaft 31*b* in a direction vertical to the transfer direction of the paper currency P. The lower bladed wheels 25*b* is rotated at higher speed than the transfer roller 22*b* by the rotation of the roller shaft 31*b*. The rotation of the lower bladed wheels 25*b* is transmitted from a roller shaft gear 31*b*-1 and a gear shaft gear 32*b*-1 to a gear shaft 32*b* by the rotation of the roller shaft 31*b* to be then transmitted to a gear shaft gear 32*b*-2 and a bladed wheel gear 25*b*-2. The bladed wheel gear 25*b*-2 is formed integrally with the bladed wheel 25*b*. The drive source of the lower bladed wheel 25*b* is used in common with the drive source of the transfer roller 22*b*. According to this constitution, the bladed wheel 25*b* starts rotating simultaneously with the rotation of the transfer roller 22*b*. The bladed wheel 25*b* can rotate at higher speed than the transfer roller 22*b* by a gear ratio between the roller shaft gear 31*b*-1, the gear shaft gear 32*b*-1, the gear shaft gear 32*b*-2, and the bladed wheel gear 25*b*-2. Since the bladed wheel 25*b* rotates at higher speed than the transfer roller 22*b*, the blades 25*b*-1 of the bladed wheel 25*b* force the front end P-1 of the paper currency P upward.

The numbers of rotations of the bladed wheels 25*a* and 25*b* are experimentally obtained. The bladed wheels 25*a* and 25*b* are provided rotatably respectively around the roller shafts 31*a* and 31*b*. However, since the bladed wheels 25*a* and 25*b* are regulated by a regulating member (not shown), the bladed wheels 25*a* and 25*b* do not move respectively in the axial directions of the roller shafts 31*a* and 31*b*.

In the second exemplary embodiment, the lower transfer roller 22*b* is fixedly provided around the roller shaft 31*b*, and the bladed wheel 25*b* is provided rotatably around the roller shaft 31*b*. However, the invention is not limited to this constitution. Namely, the bladed wheel 25*b* may be fixedly provided around the roller shaft 31*b*, and the transfer roller 22*b* may be provided rotatably around the roller shaft 31*b*. The rotating force of the roller shaft 31*b* (in this case, the shaft of the bladed wheel) is transmitted from another roller shaft through a belt (not shown), and the transfer roller 22*b* is rotatably axially supported through a bearing. The bladed wheel 25*a* may be fixedly provided around the roller shaft 31*a*, and the transfer roller 22*a* may be provided rotatably around the roller shaft 31*a*.

As described above, according to the second exemplary embodiment, the bladed wheels 25*a* and 25*b* are provided coaxially with the receiving-side upper and lower transfer rollers 22*a* and 22*b*. According to this constitution, even if the deformed front ends P-1 and P-2 of the paper currency P are folded upward or downward, the paper currency P can be introduced in between the transfer belts 24*a* and 24*b*. Accordingly, there can be obtained a medium transfer device which prevents the paper currency jamming, and, at the same time, does not complicate the structure, and has a paper currency transfer section requiring no dedicated drive source.

The first and second exemplary embodiments have described the example in which the sending-side paper currency transfer passage 11 and the receiving-side paper currency transfer passage 21 are located horizontally. However, the invention is not limited to this example, and the invention is also applicable to an example in which the sending-side paper currency transfer passage 11 and the receiving-side paper currency transfer passage 21 are located vertically. The first and second exemplary embodiments have further described the example in which the sending-side paper currency transfer passage 11 and the receiving-side paper currency transfer passage 21 are disposed linearly. However, the invention is not limited to this example, and the invention is also applicable to an example in which the sending-side paper currency transfer passage 11 and the receiving-side paper currency transfer passage 21 are disposed with a certain angle.

As the paper currency transfer section 7, when the paper currency is transferred from the sending-side paper currency transfer passage 11 to the receiving-side paper currency transfer passage 21 in one direction, the invention is not limited to the constitution in which the bladed wheel 25 is provided coaxially with the receiving-side transfer roller 22. Namely, when the paper currency is delivered bi-directionally between the sending-side paper currency transfer passage 11 and the receiving-side paper currency transfer passage 21, the bladed wheels 25 may be provided around both the receiving-side transfer roller 22 and the sending-side transfer roller 23.

As a medium to be transferred, although the paper currency P has been described as an example, the invention is not limited to this example and is applicable to all paper sheets.

What is claimed is:

1. A medium transfer device, which delivers a medium from a first transfer passage to a second transfer passage, comprising:

a receiving-side transfer roller which sends the medium to the second transfer passage; and a bladed wheel provided coaxially with the receiving-side transfer roller, wherein the bladed wheel rotates at a higher speed than the receiving-side transfer roller.

2. The medium transfer device according to claim 1, wherein the receiving-side transfer roller comprises a pair of transfer rollers, and the bladed wheel is coaxial with one of the pair of transfer rollers.

3. The medium transfer device according to claim 1, wherein a drive source of the bladed wheel is also used with the receiving-side transfer roller.

4. A medium transfer device, which delivers a medium from a first transfer passage to a second transfer passage, comprising:

a receiving-side transfer roller which sends the medium to the second transfer passage;

a bladed wheel provided coaxially with the receiving-side transfer roller;

a pair of shafts; and a sending-side transfer roller in the first transfer passage, the sending-side transfer roller including a pair of transfer rollers, including an upper transfer roller and a lower transfer roller, holding the medium and that are each disposed on one of the pair of shafts, wherein the shaft the lower transfer roller is disposed on is located on a more downstream side than the shaft the upper transfer roller is disposed on.

5. The medium transfer device according to claim 1, wherein the receiving-side transfer roller forms the second transfer passage and comprises a pair of transfer rollers, and the bladed wheel includes a pair of bladed wheels that are provided coaxially with each of the pair of transfer rollers.

6. The medium transfer device according to claim 5, further comprising a pair of shafts, wherein one of the pair of bladed wheels is provided rotatably around each of the shafts, and one of the pair of transfer rollers is fixed around each of the shafts.

7. The medium transfer device according to claim 5, further comprising a pair of shafts, wherein one of the pair of bladed wheels is fixed around each of the shafts, and one of the pair of transfer rollers is provided rotatably around each of the shafts.

8. The medium transfer device according to claim 7, wherein each of the air of bladed wheels rotates at a higher speed than each of the pair of transfer rollers.

9. The medium transfer device according to claim 8, wherein a drive source of the pair of bladed wheels is also used with a the transfer rollers.

10. The medium transfer device according to claim 7, wherein one of the pair of bladed wheels is located at a different position in an axial direction than the other bladed wheel of the pair of bladed wheels.

11. An automatic paper currency deposit/withdrawal machine comprising the medium transfer device according to claim 1.

12. The medium transfer device according to claim 4, wherein the receiving-side transfer roller forms the second transfer passage and comprises a pair of transfer rollers, and the bladed wheel includes a pair of bladed wheels that are provided coaxially with each of the pair of transfer rollers of the receiving-side transfer roller.

* * * * *